United States Patent [19]

Thompson et al.

[11] 4,258,803

[45] Mar. 31, 1981

[54] CORE BARREL FOR OBTAINING AND RETRIEVING SUBTERRANEAN FORMATION SAMPLES

[75] Inventors: Charles M. Thompson, Carrollton; Charles T. Thompson, Dallas, both of Tex.

[73] Assignee: American Coldset Corporation, Addison, Tex.

[21] Appl. No.: 916,466

[22] Filed: Jun. 21, 1978

[51] Int. Cl.[3] ..... E21B 25/06

[52] U.S. Cl. ..... 175/233; 175/59; 175/240; 175/243; 175/245

[58] Field of Search ..... 175/245, 59, 58, 251, 175/252, 233, 226, 236, 237, 239, 240, 241, 254, 243

[56] References Cited

U.S. PATENT DOCUMENTS

| | | | |
|---|---|---|---|
| 2,734,719 | 2/1956 | Otway | 175/233 |
| 2,953,157 | 9/1960 | Osborne et al. | 166/153 UX |
| 3,548,958 | 12/1970 | Blackwell | 175/233 |
| 4,142,594 | 3/1979 | Thompson et al. | 175/233 X |

FOREIGN PATENT DOCUMENTS

| | | | |
|---|---|---|---|
| 250808 | 8/1969 | U.S.S.R. | 175/59 |

*Primary Examiner*—William F. Pate, III

*Attorney, Agent, or Firm*—Kenyon & Kenyon

[57] ABSTRACT

Core barrel apparatus for obtaining and retrieving sealed core samples of subterranean formations are disclosed. The core barrel comprises a sample chamber for receiving a core sample as it is formed at the bottom of a bore hole and an expansion chamber for receiving sample fluids. The expansion chamber comprises a cylinder having a movable sealing member therein adapted to movably seal the expansion chamber. The volume of the expansion chamber is determined by the position of the sealing member in the cylinder, movement of the sealing member changing the volume of the expansion chamber. The sample chamber and expansion chamber are selectively connected to one another by means of a seal therebetween. The expansion chamber is sealed closed by the sealing member at one end and said seal at the other end while the sample is being cut and received within the sample chamber. Thereafter, the lower portion of the sample chamber is sealed by a flap-valve and the expansion chamber is opened to the sample chamber. The movable sealing member moves during ascent to expand the expansion chamber and reduce the pressure therein. A cup-like member, a piston, a spheroidal member, and a bellows member are disclosed to be embodiments of the movable sealing member. Valving is provided in the sample and expansion chambers so that the chambers may be individually sealed and separated, and sample fluids removed from the chambers through the respective valves.

26 Claims, 16 Drawing Figures

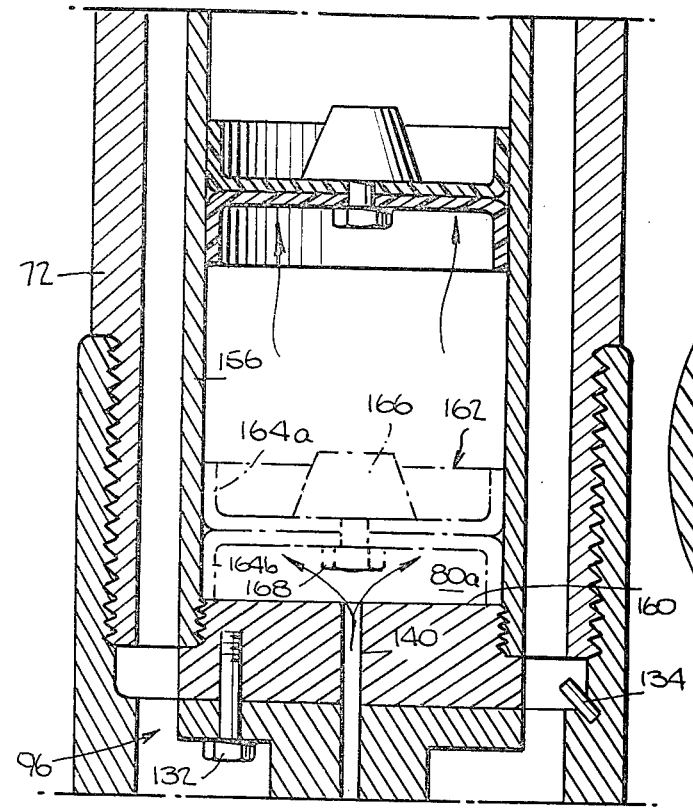
Fig. 7.
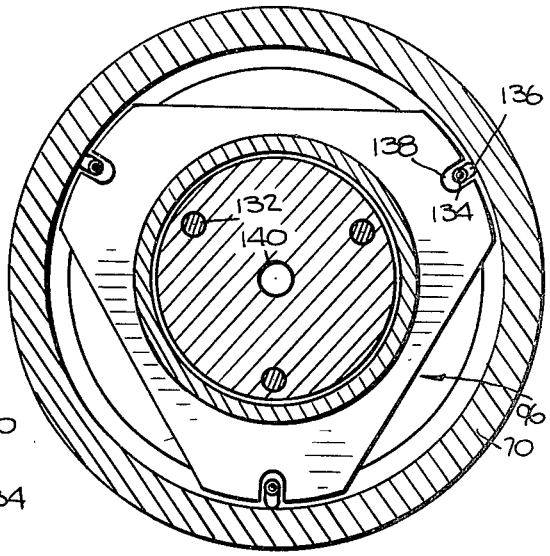
Fig. 6.
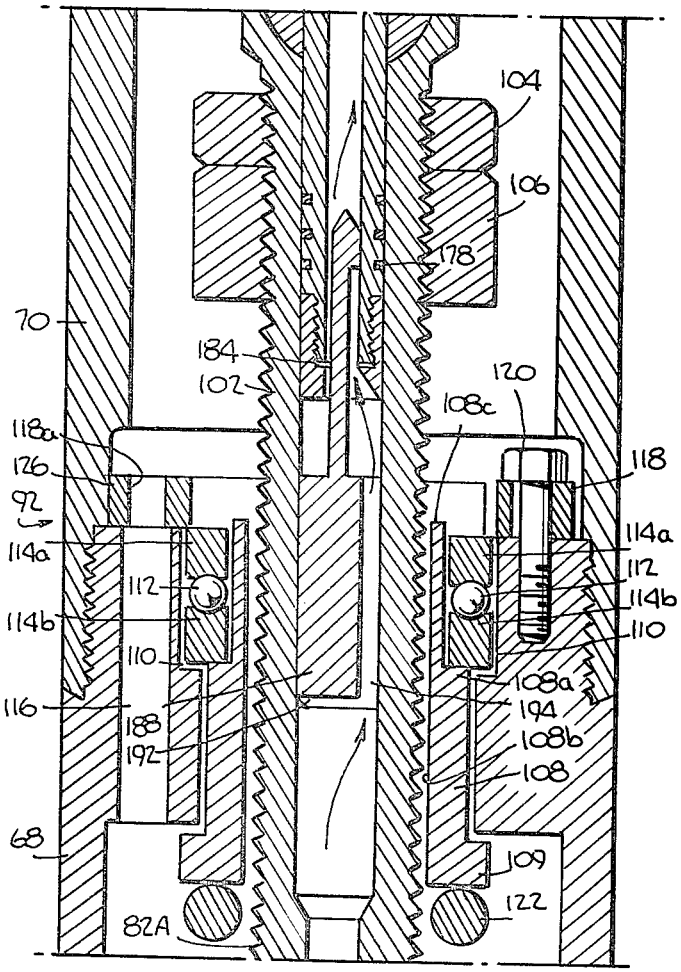
Fig. 8.
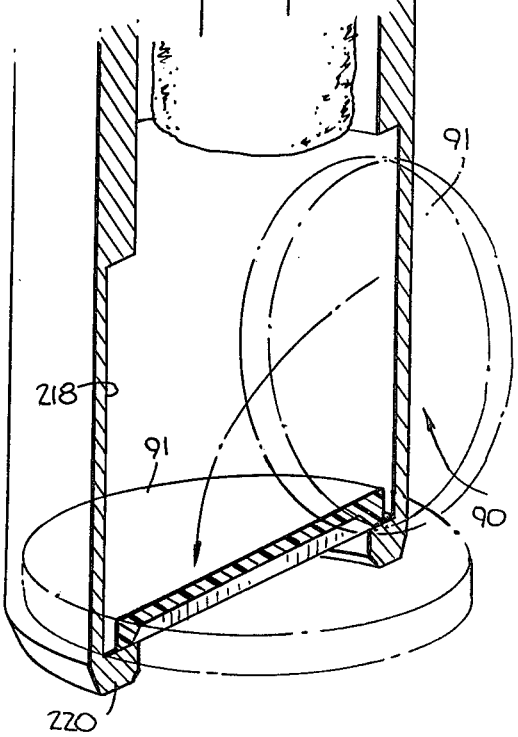

209
206
202
62
198
232
231
91
196
234
220

196
198
209
206
232
231
91
234
220

46
62
260
262
209
206
202
91
198
196
212
204
231
232
234
236

46
262
209
212
62
260
216
206
202
91
66
208
204
196
231
230
232
210a
240
234
242
198
236

CORE BARREL FOR OBTAINING AND RETRIEVING SUBTERRANEAN FORMATION SAMPLES

BACKGROUND OF THE INVENTION

1. Field of the Invention

The invention relates to core barrel apparatus for obtaining and retrieving sealed samples of subterranean formations and, more particularly, to expansion chambers and valves thereof.

2. Description of the Prior Art

In the art of obtaining samples of subterranean formations it is well known to lower a coring device or other formation sampling apparatus into a well bore while suspended by a cable, a wire line, or a drill string. It is desired that not only the solid core sample but also any fluids present therein be recovered and brought to the surface. Retaining fluids in the sampling apparatus, particularly the compressible gaseous fluids, is difficult and unreliable due to the extreme pressure differential between the sealed interior of the apparatus, in which is present the greatly elevated formation pressure at the bottom of the bore hole, and the ambient atmospheric pressure when the sampling apparatus is brought to the surface. This pressure differential varies as a function of the depth of the bore hole; however it is not uncommonly in the range of about 5,000–11,000 pounds per square inch.

Some known core barrel devices and sampling methods seal the sample at the formation pressure in a fluid-tight chamber which is capable of withstanding a high internal pressure while maintaining a fluid-tight seal as the sample is brought to the surface. Such fluid-tight chambers are provided with extremely strong and reliable seals, walls, etc. and yet are still prone to leak. Use of such chambers presents a safety hazard in that the high pressure within the chamber makes the sampling device difficult and perhaps even dangerous to handle, particularly when moving the chamber or attempting to withdraw the fluid and solid samples from the chamber.

It has been disclosed in U.S. Pat. No. 2,287,909, issued on June 30, 1942 to B. W. Sewell, that the pressure differential may be reduced by providing an expandable volume within the sampling apparatus into which volume the gases may expand to reduce the pressure differential. The sampling apparatus of the Sewell patent may not be adaptable for conditions encountered in comparatively deep bore holes due to the size of the expansion chamber shown in the Sewell '909 patent. By way of example, the bottom hole conditions in a bore hole of approximately 10,000 feet in depth could be from about 5,000–11,000 psig and 200° F. Gas or vapor under such bottom hole conditions is of a density that will cause it to expand from approximately 200–400 times in volume when elevated to surface conditions. Further by way of example, if the core sample to be taken is approximately 4 inches in diameter and 20 feet in length and if the rock sample is 20% porous with half of the porous region occupied by gas, the gas could expand to approximately 70 cubic feet when elevated to surface conditions. Accordingly, a sampling apparatus for a deep bore hole must be provided with an expansion chamber capable of expanding to an appreciable volume. Furthermore, the apparatus disclosed in the Sewell '909 patent does not provide a selectively closed expansion chamber which may be sealed from drilling fluid and other substances as the device is lowered in the well bore and as a sample is taken. Thus, the chamber of the Sewell '909 patent may become filled with drilling fluid or other unwanted substances as the core sample is being obtained. Receiving drilling fluid or other substances in the expansion chamber of the device of the Sewell '909 patent not only can detract from the usefulness of the formation sample but also volume in the chamber is occupied which could otherwise provide additional volume for gaseous components of the sample as they expand. Additionally, the chamber in which the sample is received and the expansion chamber of the Sewell '909 patent may not be individually sealed and separated.

It is apparently unknown in the prior art to maintain a sample chamber sealed or closed until opened at the bottom of a bore hole and to expand the sample chamber in response to the gases therein as the sample is brought to the surface.

The present invention overcomes the aforementioned drawbacks and disadvantages of the prior art and provides additional advantages as well.

SUMMARY OF THE INVENTION

Apparatus for obtaining and retrieving a sealed sample from a subterranean formation according to the invention includes an inner core barrel which comprises an expansion chamber for sample fluids and a sample chamber for receiving the core sample obtained from the formation. Seal means are provided for sealing the expansion chamber from the sample chamber while the apparatus is lowered in a bore hole and while the sample is being obtained and received in the sample chamber. The sample chamber includes a flap-valve which is closed to seal the lower end portion of the sample chamber after the sample is received therein. The seal means between the sample chamber and expansion chambers is opened and fluids are permitted to pass into the expansion chamber. The sample is thus sealed at formation pressure in the sample chamber at one end by the flap-valve and by the expansion chamber at the other end.

During ascent of the sealed inner core barrel to the surface, the pressure within the bore hole applied to the exterior of the sealed inner core barrel decreases. As the bore hole pressure decreases during ascent, the fluids within the expansion chamber which are initially at the high formation pressure commence to expand. The expansion chamber is operative to expand substantially in length as the pressure on the exterior of the expansion chamber decreases. The expanding of the expansion chamber provides an increasing volume therein into which the fluids can expand. The differential pressure from the interior to the exterior of the expansion chamber can thereby be maintained at a substantially low level with the result that the interior of the expansion chamber can approach surface atmospheric pressure or be at an elevated pressure which is substantially less than the pressure at which the sample was taken, as the expansion chamber approaches the surface.

According to the invention, the expansion chamber is sealed at one end by movable sealing means disposed therein and at the other end from the sample chamber initially by seal means disposed adjacent the expansion and sample chambers. The position of the movable sealing means within the expansion chamber determines the volume of the expansion chamber. In the disclosed embodiments, the expansion chamber comprises a cylinder and the movable sealing means comprises a movable sealing member or membrane disposed therein. During descent and coring, the surface portions of the movable sealing member in the interior of the expansion chamber are disposed adjacent the lower end of the cylinder and the interior of the expansion chamber is sealed from the sample chamber by the seal means, the volume of the expansion chamber being the volume between the movable sealing member and the seal means, that volume being minimal and small in comparison to the volume of the entire cylinder. After a core sample has been received and secured within the sample chamber, the flap-valve seals the lower end of the sample chamber and the seal means is opened to communicate the expansion and sample chambers which form a sealed enclosure for the sample. Thus, the sample is sealed at formation pressure at one end in the expansion chamber by the movable sealing member and at the other end in the sample chamber by the flap-valve. The volume of this enclosure is permitted to increase during ascent of the core barrel and sample core. More particularly, fluids in the sample core are permitted to enter the expansion chamber and, as the core barrel is raised towards the surface and the bore hole pressure decreases, the movable sealing member moves to expand the expansion chamber in response to the pressure differential across it between the expanding sample fluids and the decreasing bore hole pressure. The pressure within the expansion chamber is thereby maintained at or relatively near the bore hole pressure until the movement of the sealing member in the cylinder is restricted at or near the surface.

In the preferred embodiments, the movable sealing member is a cup-like packing member or a piston slidably, fluid-tightly fitted within the cylinder; or a flexible spherical, spheroidal, cylindrically or similarly shaped member which is slidably disposed within the cylinder and forms a seal between it and the cylinder by distortion of the member; or a bellows member disposed in the cylinder with one end of the bellows member secured to the cylinder adjacent to the bottom thereof. At least one opening is provided preferably at the top of cylinder for the drilling fluid to be introduced into and exit from the cylinder. The diameter of the cylinder is smaller than the diameter of the outer core barrel to provide an annular clearance therebetween for the passage of drilling fluid and the at least one opening is communicated with the annular clearance.

While at the surface, the movable sealing member or a movable portion thereof in the interior of the expansion chamber is displaced to the bottom of the cylinder with the expansion chamber unsealed so that the contents in the interior thereof are not compressed. The expansion chamber is then sealed, drilling fluid introduced into the core barrel and the core barrel is lowered into the bore hole. Since the interior of the expansion chamber is now sealed and the drilling fluid in the cylinder above the exterior of the movable sealing member is at the bore hole pressure (or greater than the bore hole pressure when the drilling fluid is pressurized), and since the sealed contents in the expansion chamber are not compressed and do not exert expansive forces against the interior surfaces of the expansion chamber, a net downward force is exerted on the exterior of the movable sealing member by the drilling fluid to maintain the surface portions of the movable sealing member in the interior of the expansion chamber at the bottom of the cylinder during descent and coring. After coring, the sample fluids are permitted to enter the expansion chamber at the pressure prevailing at the depth of the sample. During ascent, the bore hole pressure present about the exterior of the movable sealing member decreases while the pressure of the sealed sample initially does not. A pressure differential across the movable sealing member results and causes it to move upwards in the cylinder and displace drilling fluid from the cylinder. The volume of drilling fluid within the cylinder and the volume of the expansion chamber are inversely proportional, i.e., displacement of drilling fluid from the cylinder by upward movement of the movable sealing member increases the volume of the expansion chamber. At or near the surface, movement of the movable sealing member may be restricted and the sealing member may seal the opening in the cylinder preventing further passage of drilling fluid therethrough.

In addition to the seal means which initially seal the expansion chamber from the sample chamber, valve means are provided to individually and selectively seal the expansion chamber from the sample chamber and the sample chamber from the expansion chamber. Thus, the expansion chamber and sample chamber may be separated while each is individually sealed, and sample fluids may be retained in each and selectively withdrawn therefrom.

These and other aspects of the present invention will be more apparent from the following description of the preferred embodiment thereof when considered with the accompanying drawings and appended claims.

BRIEF DESCRIPTION OF THE DRAWINGS

The present invention is illustrated by way of example and not limitation in the figures of the accompanying drawings in which like references apply to like parts and in which:

FIG. 6 is a horizontal section view taken along line 6—6 of FIG. 2 and showing the expansion chamber lower terminal;

FIG. 7 is an enlarged vertical section view showing the bearing assembly for securing the transfer tube and sample chamber to the upper outer core barrel, the expansion chamber and cup-like sealing member, and also showing the seal for the expansion chamber which is adapted to be pierced by a dart in the transfer tube after the sample is taken and after the sample chamber is sealed by the flap-valve;

FIG. 8 is a perspective view partially in section of the sample chamber portion of the core barrel and showing the flap-valve being closed;

DESCRIPTION OF THE PREFERRED EMBODIMENTS

As is conventional in the art, a well bore hole is formed by means of a drill bit mounted on the end of a drill string and driven by drilling apparatus located on the surface. When the bore hole has been drilled to a depth at which it is desired to take a sample of the formation, the drill string is removed from the bore hole. A coring device is then attached to the lower end of the drill string in place of the drill bit. The drill string is then lowered into the bore hole. Rotation of the drill string causes the coring device to cut a core sample from the formation at the bottom of the bore hole. The drill string and coring device with a core sample retained therein are finally removed from the bore hole and the coring device is separated from the drill string at the surface.

Figure 1:
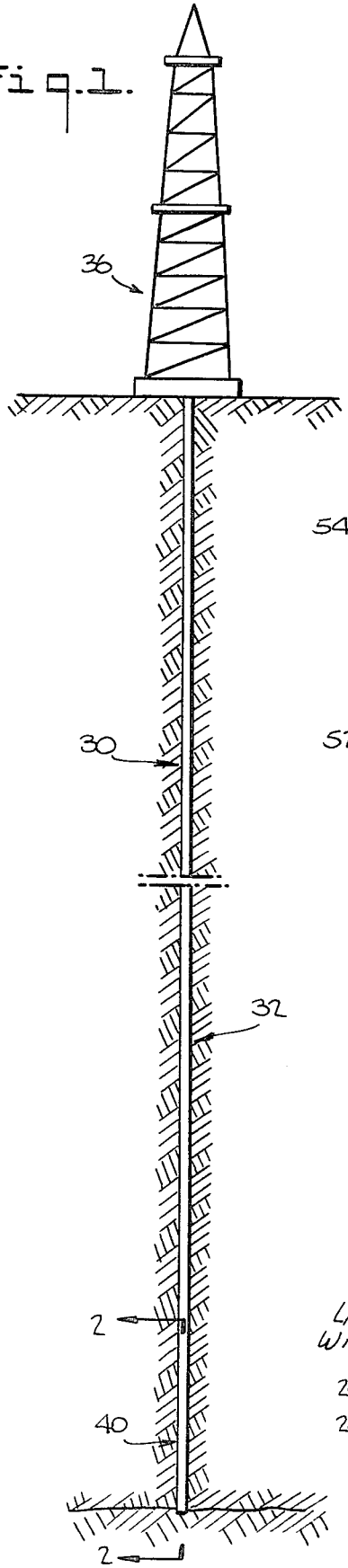
FIG. 1 is a schematic diagram showing the core barrel apparatus of the invention attached to a drill string in a well bore hole.
Figure 2:
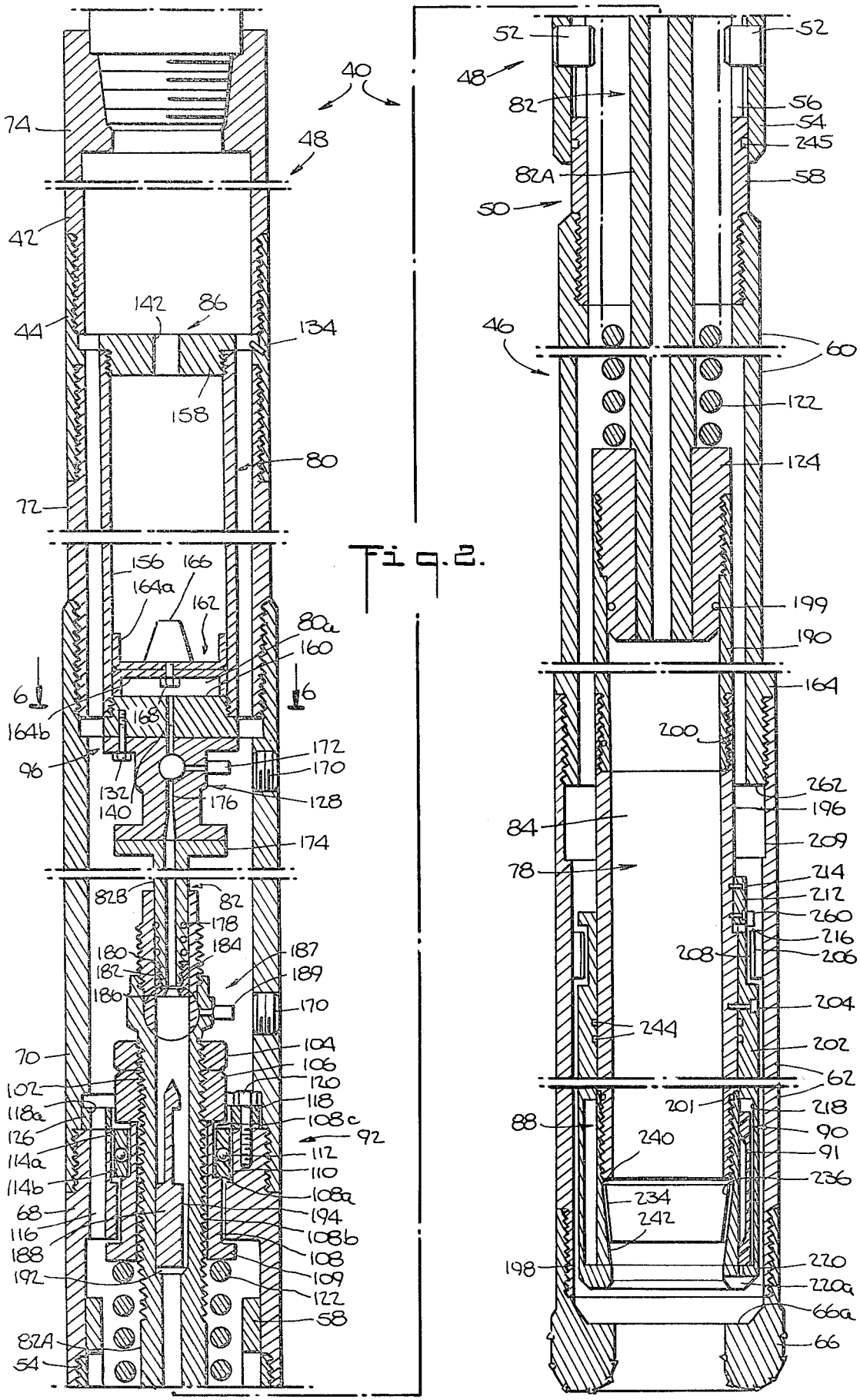
FIG. 2 is a vertical section view in two portions of the core barrel apparatus of FIG. 1 taken along line 2—2 thereof and showing the inner core barrel, the upper and lower outer core barrels, the expansion chamber, the sample chamber, the transfer tube and its seal, and the flap-valve in the position in which the core barrel apparatus is lowered into the well bore.

In accordance with a preferred embodiment of the present invention, the coring device is a core barrel assembly which is attached to a drill string. Referring to FIG. 1, the well bore hole is referenced by 30, the drill string by 32 and the surface apparatus by 36. Referring to FIG. 2, the core barrel assembly according to a preferred embodiment of the invention is referenced generally by 40. Core barrel assembly 40 comprises an inner core barrel and an outer core barrel between which drilling fluid or mud is forced in a downward direction. Thus, drilling mud is passed downwardly through the interior of the drill string and to the core barrel assembly when a core is being cut. The drilling fluid or mud flows back to the surface between the wall of the bore hole and the exterior of the drill string and core barrel.

Core barrel assembly 40 (FIG. 2) is secured to a section (not shown) of drill string by a threaded sub or drill collar (not shown). The outer core barrel comprises a lower outer barrel section 46 and an upper outer barrel section 48 connected to one another by a bayonet-type slip-joint coupling 50. More particularly, this coupling, as shown more clearly in FIGS. 3–5, includes pins 52 which are secured in lower transfer tube housing 54 of upper barrel 48 and which are movable in J-slots 56 disposed in inner J-slot coupling member 58. Slip-joint coupling 50 provides for limited relative axial and rotational movement between the upper outer barrel section 48 and the lower outer barrel section 46 as well as the inner core barrel and parts thereof while permitting torque to be transmitted between the upper and lower outer barrel sections.

The upper and lower outer barrel sections 48 and 46 respectively comprising the outer core barrel are made up of individual sections and couplings as follows (FIG. 2). The lower core barrel section 46 comprises: lower transfer tube housing 60 threadedly secured to inner slip-joint coupling member 58; core bit sub 62; core bit sub coupling 64 threadedly securing housing 60 and sub 62; and core bit 66 threadedly secured to sub 62. The upper core barrel section 48 comprises: upper transfer tube housing 54 secured to the inner slip-joint coupling member 58 by pins 52 for limited, relative axial and radial movement therewith; bearing housing 68 threadedly secured to housing 54; valve housing 70 threadedly secured to housing 68; expansion chamber housing 72 threadedly secured to housing 70; upper housing 42; and an outer barrel coupling 44 securing housing 72 to housing 42. The outer core barrel terminates in head 74 which is secured to the upper housing 42 by outer barrel coupling 44. Drill string sections (not shown) are connected to head 74 and each other to form the drill string. While it is understood that a plurality of sections and couplings may comprise sub 62 and housings 60, 70 and 72, only one section for each has been shown for clarity.

Elements 66, 62, 64, 60, 58, 54, 68, 70, 72, 44, 42 and 74 form the outer core barrel which extends from the lower end of the drill string 32 to the core bit 66. Disposed within the interior of the core barrel assembly 40 is an inner core barrel referenced generally by 78 (FIG. 2). The inner core barrel comprises three main parts which include, the expansion chamber 80, transfer tube 82 and sample chamber 84. The inner core barrel which extends from the expansion chamber upper terminal 86 to the core catcher sub, referenced generally by 88, is adapted to secure a core sample within sample chamber 84. A flap-valve 90 is provided for sealing the lower end of the inner core barrel.

Clearance is provided between the inner and outer core barrels for the circulation of drilling fluid therebetween. The drilling fluid is delivered downwardly through the interior of the drill string. The drilling fluid flows between the inner and outer core barrels adjacent the core bit 66. Thus, when the outer core barrel is rotated to cut a core sample, drilling fluid is circulated through the drill string between the inner and outer barrels and supplied to core bit 66 to lubricate and cool the bit. Thereafter, the drilling fluid passes back up the bore hole about the exterior of the outer core barrel and drill string. Core bit 66 may be a diamond core bit.

The inner core barrel 78 is supported and guided within the outer core barrel for relative rotational movement therebetween by bearing assembly 92. Transfer tube 82 includes a lower portion 82A and an upper portion 82B. As shown in FIGS. 2 and 7, transfer tube lower portion 82A (to which is connected sample chamber 84) is secured to the outer core barrel (bearing housing 68) for relative rotation therebetween by bearing assembly 92. Thus, when the drill string and outer core barrel are rotated to cut a core sample, lower transfer tube 82A and sample chamber 84 of inner core barrel 78 remain stationary (FIG. 2).

Lower transfer tube 82A terminates at its upper end in a threaded section 102. Lower transfer tube 82A is supported with respect to housing 68 by bearing 112. Upper spring seat 108 includes an axial bore **108*b* adapted to fit about the exterior circumference of threaded section 102 for slidable movement therealong. In annular recess 110 within housing 68 is disposed ball bearing 112 having upper and lower bearing races 114*a* and 114*b*, respectively. Axial bores 116 are provided in housing 68 to permit passage therethrough of drilling fluid between the inner and outer barrels as mentioned hereinbefore. Bearing retainer 118 mounted on housing 68 by screws 120 engages upper bearing race 114*a* and secures the bearing 112 against upward movement by urging the lower bearing race 114*b* against annular seat 108*a* of spring seat 108. Bearing retainer 118 contains openings 118*a* which align with bores 116 in bearing housing 68, thereby providing passages for the drilling fluid. The bearing assembly 112 has its upper race 114*a* biased against retainer 118 by the upward force of spring 122 applied to spring seat 108 and thereby to lower race 114*b*. Transfer tube 82A is biased downwardly by spring 122 and is maintained in position by the piloting action of the bore 108*b* of spring seat 108. The adjustment nut 106 attached to the threaded section 102 bears upon the upper end 108*c* of spring seat 108 in response to the downward force applied to transfer tube 82A by spring 122. The downward force is applied by the lower end of spring 122 to lower spring seat 124 which will be described more fully hereinafter. An annular recess 126 coextensive in part with openings 118*a* is provided in valve housing 70** for the passage of drilling fluid or mud.

Referring now to FIGS. 6 and 7 and again to FIG. 2, expansion chamber 80 and upper transfer tube 82B of the inner core barrel are supported within the outer core barrel by expansion chamber terminals 86, 96. The lower terminal 96 supports upper transfer tube 82B and expansion chamber valve 128 within the outer barrel, the valve being secured to the terminal by mounting bolts 132. The terminal 96 is secured to the valve housing 70 by Rollpin-type fasteners 134 disposed in slots 136 and 138 of the terminal and valve housing (FIG. 6). The Rollpin-type fasteners are longitudinally split, hollow cylindrical pins made of a spring metal material, frictionally engaged within mounting holes in housing 70. Terminal 96 has a central opening 140 therein which communicates with the opening in valve 128. The upper transfer tube 82B is telescoped into section 102 of the lower transfer tube 82A for relative rotational and axial movement as will be described more fully hereinafter. Terminal 96 is of triangular outline form and therefore its peripheral edges form clearances with the cylindrical interior surface of the outer core barrel (FIG. 6). The clearances between the edges of the terminal and the inner surface of the outer core barrel permit passage of drilling fluid therebetween. Expansion chamber upper terminal 86 (FIG. 2) is similar to terminal 96, being of triangular outline form and secured to coupling 44 by Rollpin-type fasteners 134. Terminal 86 includes a central opening 142 therethrough.

Referring to FIGS. 2 and 7, expansion chamber 80, a portion of the inner core barrel, comprises upper and lower terminals 86, 96 and cylinder 156. Cylinder 156 is internally threaded at opposed ends thereof and terminals 86, 96 each include an externally threaded central projection 158, 160, respectively. Cylinder 156 is thereby threadedly secured to the terminals, being fluid-tightly secured to terminal 96. The expansion chamber also includes a movable sealing member 162 which comprises opposed cup-like packings **164*a*, 164*b* and stop 166 secured thereto by bolt 168. The packings are made of a resilient material and fitted within the cylinder to provide a slidable, fluid-tight seal therebetween. Preferably, the packings are made from molded rubber and the cylinder is made from steel. Bolt 168 fluid-tightly secures the packings together, although the packings may also be molded as a unit. Member 162 is slidably movable within cylinder 156 in response to a pressure differential across it. Thus, a fluid-tight, expandable chamber 80*a* is formed within cylinder 156 by member 162, projection 160 of terminal 96 and the cylinder walls, opening 140 being sealed by sealing disc 184 which will be described hereinafter. By way of example, the expansion chamber can be approximately sixty feet in length when fully expanded, i.e., the cylinder can be approximately 60 feet long. Further by way of example, the cylinder may have a diameter of approximately 6-7/8 inches. Valve 128 which can be a ball valve is disposed in passage 176 to permit removal of fluids while blocking communication of passage 176 and opening 140. However, valve 128 normally communicates passage 176 and opening 140 to chamber 80A. A removable plug 170 provided in valve housing 70 permits access to actuator 172 of valve 128 from the exterior of the housing. Expansion chamber 80, including the valve and terminals, and upper transfer tube 82B rotate with the outer core barrel and drill string. Valve 187 which also can be a ball valve is disposed in upper transfer tube 82B to permit removal of fluids from sample chamber 84 while blocking communication of the interior of the upper transfer tube with passage 176. However, valve 187 normally communicates passage 176 with the interior of the upper transfer tube 82B. Another removable plug 170 is provided in to valve housing 70 to permit access to the actuator 189** of the valve from the exterior of the housing.

Connecting expansion chamber 80A to sample chamber 84 is transfer tube 82 comprised of upper transfer tube 82B and lower transfer tube 82A (FIG. 2). Upper transfer tube 82B is connected to valve 128 by means of plate 174 to provide fluid-tight communication between passage 176 of the valve and the interior of the upper transfer tube. The lower end of the upper transfer tube 82B is disposed in the interior of the upper end of the lower transfer tube 82A for axial and rotational movement therein. A plurality of O-ring seals 178 (FIG. 7) enable the axial and rotational movement to take place without leakage. The lower end of upper transfer tube 82B terminates in externally threaded section 180 and a threaded sleeve or disc retainer 182. A sealing disc 184 is disposed on a shoulder on disc retainer 182, the disc being clamped at the shoulder by sleeve 180 to form a fluid-tight seal. A tool socket or slot 186 is provided at the lower end of disc retainer 182 to enable section 182 to be driven onto section 180. Lower transfer tube 82A is retained at one end thereof in bearing housing 68 and the other end terminates in lower spring seat 124 (FIG. 2). Spring seat 124 is threadedly secured in upper portion of barrel 190 of the sample chamber.

The base portion of dart 188 has an axial slot 194 therein for the passage of fluids therethrough. The tip of dart 188 is spear-shaped to permit passage of fluid from the lower transfer tube 82A to the upper transfer tube 82B after the dart has ruptured sealing disc 184 (FIG. 7), the fluid passing through axial slot 194, through the space between the dart and the ruptured seal, and past the spear-shaped tip of the dart.

Lower transfer tube 82A is axially movable with respect to bearing housing 68 and the outer barrel since it is slidable within spring seat 108. Nut 106 attached to the threaded upper end 102 of transfer tube 82A controls the position of the lower transfer tube by engaging end 108C of spring seat 108. Adjustment nut 106 enables the position of the lower transfer tube with respect to the outer core barrel to be selectively set. Jam nut 104 secures nut 106 in its adjusted position on threaded section 102.

Upper transfer tube 82B is fixed to the outer barrel as described hereinbefore. The relative axial movement between the upper and lower transfer tubes causes dart 188 to strike and pass through sealing disc 184, thereby enabling fluids to enter the expansion chamber 80A.

As shown in FIG. 2, the sample chamber 84 comprises upper barrel 190, sample chamber sub 196 and core catcher sub 198. Barrel 190 is threaded at one end to spring seat 124 and at the other end to sub 196 which in turn is threaded to sub 198. O-ring seals 199-201 are provided to seal the respective joints. Telescoped over subs 196 and 198 is flap-valve housing 202 which is secured to sub 196 by shear screw 204. Latch ring 206 is carried in circumferential slot 208 in housing 202 and is axially moveable together with housing 202 in core bit sub 62. Ring 206 which is split and spring-tensioned radially outwardly is maintained in compression by core barrel sub 62. When ring 206 is moved into annular slot 209 of core barrel sub 62, ring 206 expands radially in an outward direction to engage the walls of the slot. Ring 206 has axial slots 210 radially disposed about is outer periphery to permit passage of drilling fluid. Key 212 is secured to the exterior of sample chamber sub 196 by bolts 214. An axial slot or keyway 216 is provided in flap-valve housing 202 to prevent relative rotation between housing 202 and sub 196, as will be more fully described hereinafter.

Disposed in annular slot 218 of flap-valve housing 202 and resting on shoulder 220 thereof is flap-valve 90. Flap-valve 90 which includes flap member 91 is flexible in one plane. When stored in the open position of the valve in annular recess 218, the flap member 91 has a partially cylindrical, deflected shape conforming to the inner surface of slot 218 and the outer surface of the core catcher sub 198. When the valve is closed, flap member 91 is seated on shoulder 220 and is disc-like in shape with a planar horizontal cross section as shown in FIG. 8.

Flap member 91 comprises a circular, resilient, fluid-sealing base and a plurality of closely-spaced, narrow load bearing elements or bars extending parallel to one another. The base is preferably made of a resin material or natural or synthetic rubber but may also be made of other fluid-impermeable, resilient materials. The bars each include a rib which has a trapezoidally-shaped transverse section. The resilient base is molded about the bars and engaged to the ribs of each. The bars are juxtaposed and separated by a small space. Due to the resiliency of the base, the trapezoidal shape of the ribs, and the spaces between the bars, the entire flap member 91 may be deflected or flexed about an axis or axes corresponding to the longitudinal axis of one or more bars. The flap member 91 is shown deflected in FIGS. 2 and 9-10 to conform to the cylindrical shape of the annular recess 218 by the outer surface of sub 198. Upon raising sub 198 (FIGS. 8 and 11-12) above flap member 91, the flap member springs out into a planar configuration. A retainer or leash 230 which is preferably made of wire material (FIGS. 9-12) is attached by screw 231 to the flap member and screw 232 to slot **220*a* in shoulder 220 to urge flap member 91 to swing downwardly into its closing position. Thus, the leash insures that the flap member closes in a hinge-like manner and properly seats upon shoulder 220**.

Mounted in core catcher sub 198 is core catcher 234 for engaging a core received in chamber 84 and preventing the core from falling therefrom (FIGS. 9-12). The core catcher can assist in the procedure of the breaking of the core from the bottom hole formation after a sufficient core has been obtained. Core catcher 234 is generally in the shape of a trucated cone, slidably mounted in mating annular groove 236 in sub 198. The core catcher has axial serrations or teeth which are tapered in a radial direction with respect to longitudinal axis of the core catcher. Thus, the teeth taper from a maximum thickness at the top 240 of the catcher to a minimum thickness at the base 242 thereof. Core catcher 234 is split longitudinally with the result that its inside diameter decreases in accordance with downward movement in annular groove 236. As a result, core catcher 234 permits upward axial movement of a core but not downward movement. The catcher, whenever moved downwardly by a core, contracts in diameter, thereby resulting in the serrations grasping the core and preventing further downward movement thereof. This is shown in FIGS. 9-12.

O-ring seals 244 positioned between sample chamber sub 196 and flap-valve housing 202 permit relative axial movement between the sub and housing while sealing the two against fluid flow therebetween. Thus, seals 244 prevent passage of drilling fluid between sub 196 and housing 202 up into chamber 84.

Figure 3:
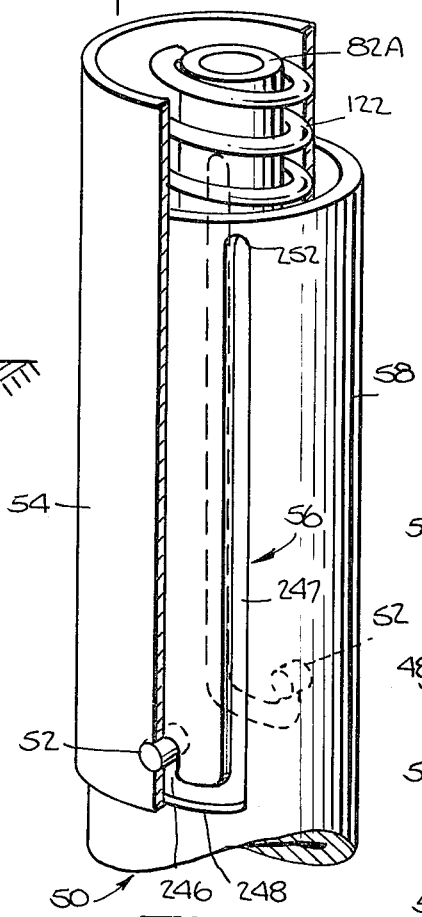
FIG. 3 is a fragmentary perspective view partially in section showing the slip-joint of the apparatus connecting the upper and lower outer core barrels positioned as they are shown in FIG. 2.
Figure 4:
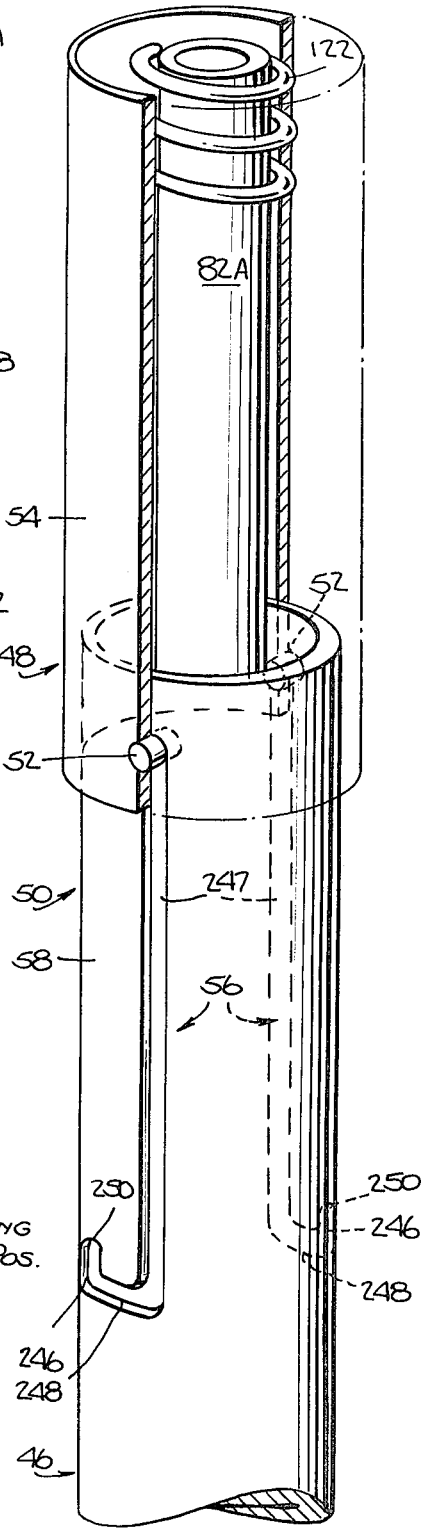
FIG. 4 is a perspective view partially in section showing the slip-joint in another position corresponding to the seating of the flap-valve member to close the sample chamber.
Figure 5:
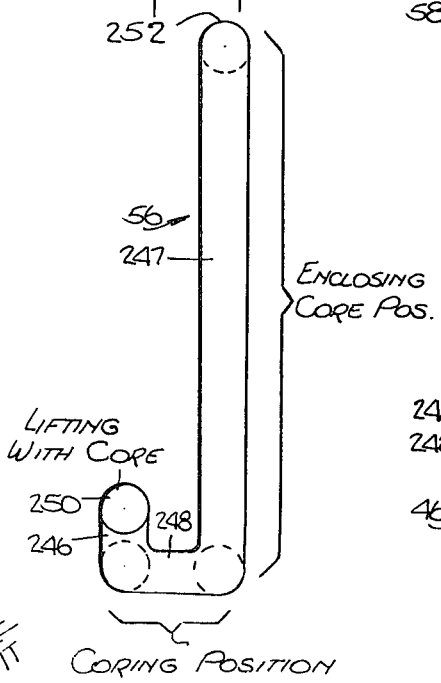
FIG. 5 is a schematic diagram showing the J-slot of the slip-joint and illustrating the position of the pins of the slip-joint corresponding to different operations of the core barrel apparatus.

As mentioned hereinbefore, slip-joint coupling 50 provides for relative axial and radial movement between upper core barrel 48 and lower core barrel 46. An O-ring seal 245 is provided between coupling member 58 and housing 54. Referring to FIGS. 3-5, pins 52 are fixed and retained in lower transfer tube housing 54 by keeper springs, and J-slots 56 having short axial slot 246, long axial slot 247 and radial slot 248 are disposed in coupling member 58. Axial slots 246, 247 limit the axial movement of pins 52 therein and radial slot 248 limits the radial movement of the pins 52 therein. Drilling torque is transmitted through the drill string from the upper barrel pins 52 to coupling member 58 of the lower barrel by engagement of the pins against the axial walls of the slots. The upper barrel supports the lower barrel when pins 52 are in the uppermost ends 250 of axial slots 246 (FIG. 3) when the drill string is being lowered into or raised out of the well bore, and when pins 52 are in the uppermost ends 252 of axial slots 247 (FIG. 4) when the core is being broken and the sample chamber sealed, as will be described more fully hereinafter.

OPERATION

Core barrel 40 operates with drill string 32 to obtain a sample as follows. At the surface, with the core barrel disassembled and the sealing disc 184 and the sealing member 162 not installed, valve 128 is closed and a measured quantity of an inert, incompressible fluid such as distilled water is introduced into the cylinder while it is vertically upright. The sealing member 162 is installed and the cylinder rotated so that valve 128 is higher than the sealing member 162. Valve 128 is opened to vent the cylinder to the atmosphere and the sealing member displaced to the bottom of the cylinder. Since the cylinder is open to the atmosphere, all the air and some of the water below sealing member 162 are forced out of the expansion chamber as the sealing member moves to the bottom of the cylinder, the displaced water being measured to determine the quantity of water remaining in the cylinder. The cylinder may need to be turned vertically to evacuate its interior such that there is a minimal amount of the non-compressible fluid therein. In the alternative, a vacuum pump can be used to evacuate the cylinder. Thereafter, the core barrel is fully assembled and disc 184 installed to seal the expansion chamber. The expansion chamber is sealed with water therein and all the air removed therefrom. Thus, the contents of the expansion chamber are not compressed. Drilling fluid is introduced into the core barrel to remove air therefrom as described hereinafter. Core barrel 40 which includes the core bit 66 is attached to drill string sections and lowered into well bore 30, drilling fluid entering into the drill string and into the cylinder above the sealing member 162. Since the interior of the expansion chamber **80*a* is sealed and the drilling fluid in the cylinder above the sealing member 162** is at the bore hole pressure, and since the sealed contents in the expansion chamber are not compressed and do not exert an upward force against the sealing member, a net downward force is exerted on the sealing member by the drilling fluid to maintain the sealing member at the bottom of the cylinder during descent and coring.

As core barrel 40 is being lowered into the well bore, the relative positions of the core barrel members are as follows. Referring to FIGS. 2, 3 and 5, the lower barrel section 46 (coupling member 58) is supported by the upper barrel section 48 (lower transfer tube housing 54) by pins 52 in upper-most ends 250 of short axial slots 246 of the J-slots 56 in coupling member 58. Thus, the sample chamber 84 is supported by pins 52 as the core barrel is being lowered into the bore hole. In this position, adjustment nut 106 is adjusted to move the lower transfer tube 82A in the bearing assembly 92 so that the distal end of the inner core barrel (shoulder 220 of flap-valve housing 202) assumes the position shown in FIG. 2. As shown in FIG. 2, the clearance between the lower face of shoulder 220 and the upper face **66*a* of core bit 66 is of an intermediate distance. Axial spring 122 is pre-tensioned by adjusting nut 106, thereby causing compression of the spring against shoulder 108*a* of spring seat 108. The spring seat is thereby urged against bearing 112. Nut 106 is adjusted to obtain the desired clearance of the lower face of shoulder 220 with respect to the upper face 66*a* of the core bit. The adjustment is made to cause the clearance to be a limited one as shown in FIG. 2 when the apparatus is in the coring condition, i.e. when pins 52 are disposed in slots 248 shown in FIG. 5. By way of example, the clearance can be approximately one-eighth inch. Jam nut 104 locks nut 106** in its adjusted position.

Spring 122 assists in maintaining the lower transfer tube 82A and the sample chamber 84 in the position shown in FIG. 2. Shear screw 204 prevents relative axial movement between sample chamber sub 196 and flap-valve housing 202. Key 212 in keyway 216 prevents relative radial movement between the sub 196 and housing 202.

The drill string and core barrel are thus lowered in the well bore until the core bit 66 reaches the bottom of the well bore. At this point, the upper barrel 48 moves axially downwardly with respect to the lower barrel 46 in slip-joint 50. In particular, pin 52 travels down axial slot 246 until it strikes the bottom of the J-slot. This position is shown in FIG. 5 and is referenced as "coring position". The positioning of the slot 248 of J-slot 56 limits the lowest axial position of the upper core barrel and inner core barrel relative to the lower core barrel. This limited axial relative position causes shoulder 220 to be separated from core bit 66 by the adjusted narrow clearance referred to above and shown in FIG. 2. This clearance is sufficiently large to permit the passage of drilling fluid between shoulder 220 and the core bit 66 while at the same time inhibiting the flow of drilling fluid upwardly into the interior of sample chamber 84. Again this narrow clearance is predetermined by the positioning of slots 246 and 248 and the setting of adjustment nut 106.

With the core bit in the configuration shown in FIG. 2, the drill string is rotated, thereby rotating the outer lower core barrel 46 and core bit 66 to cut a core sample from the formation. Shear screw 204 secures sample chamber sub 196 and flap-valve housing 202 against movement therebetween. Thus, there is no relative axial movement between the sample chamber sub and the flap-valve housing. Key 212 is positioned in short keyway 216 of the flap-valve housing to prevent radial movement or rotation between the flap-valve housing and the sample chamber sub.

As core bit 66 is rotated, the sample chamber 84 remains stationary and sample material progresses upwardly into the core chamber while the core barrel and drill string progress downwardly into the formation. When a sufficient amount of core has been taken into the sample chamber (for example, 20 feet of core), it becomes necessary to break the core from the formation. The amount of core sample taken is determined from the surface by observing the distance that the drill string moves downwardly into the formation while coring. During coring, the major portion of the weight of the drill string and core barrel apparatus is supported from the surface with the result that a controlled reduced force urges the core bit against the bottom of the bore hole.

During the time that the drill string and core barrel are lowered into the well bore and during the time that the sample is being cored, dart 188 assumes the position shown in FIG. 2 in which seal 184 is intact. Therefore, the expansion chamber 80A is completely sealed during lowering and during coring operations. Accordingly, no drilling fluid or other substances are permitted to enter the expansion chamber. On the way down into the well bore hole, the expansion chamber 80A has minimum volume as shown in FiG. 2. This, as mentioned, is due initially to the weight of the fluid and then to the external pressure of the drilling fluid or mud being applied to the exterior of the expansion chamber and particularly above member 162. This external pressure can increase at the rate of approximately ½ to slightly in excess of one pound per square inch pressure per foot of depth. Thus, when the core barrel is lowered to a depth of about 10,000 feet, the external pressure will be about 5,000–11,000 pounds per square inch.

When the desired amount of core has been taken as determined by measurements at the surface, rotation of the drill string is stopped. The core then must be broken from the formation at the location of the entrance to the inner core barrel. There are several ways to accomplish this. One way is to cause surges in the pressure of the pump supplying the drilling fluid to provide a varying lifting force to the core barrel and drill string at the bottom of the well. Another way is to intermittently start and stop the rotation of the core barrel and drill string. This latter method is known as rocking.

Figures 9, 10, 11, 12:
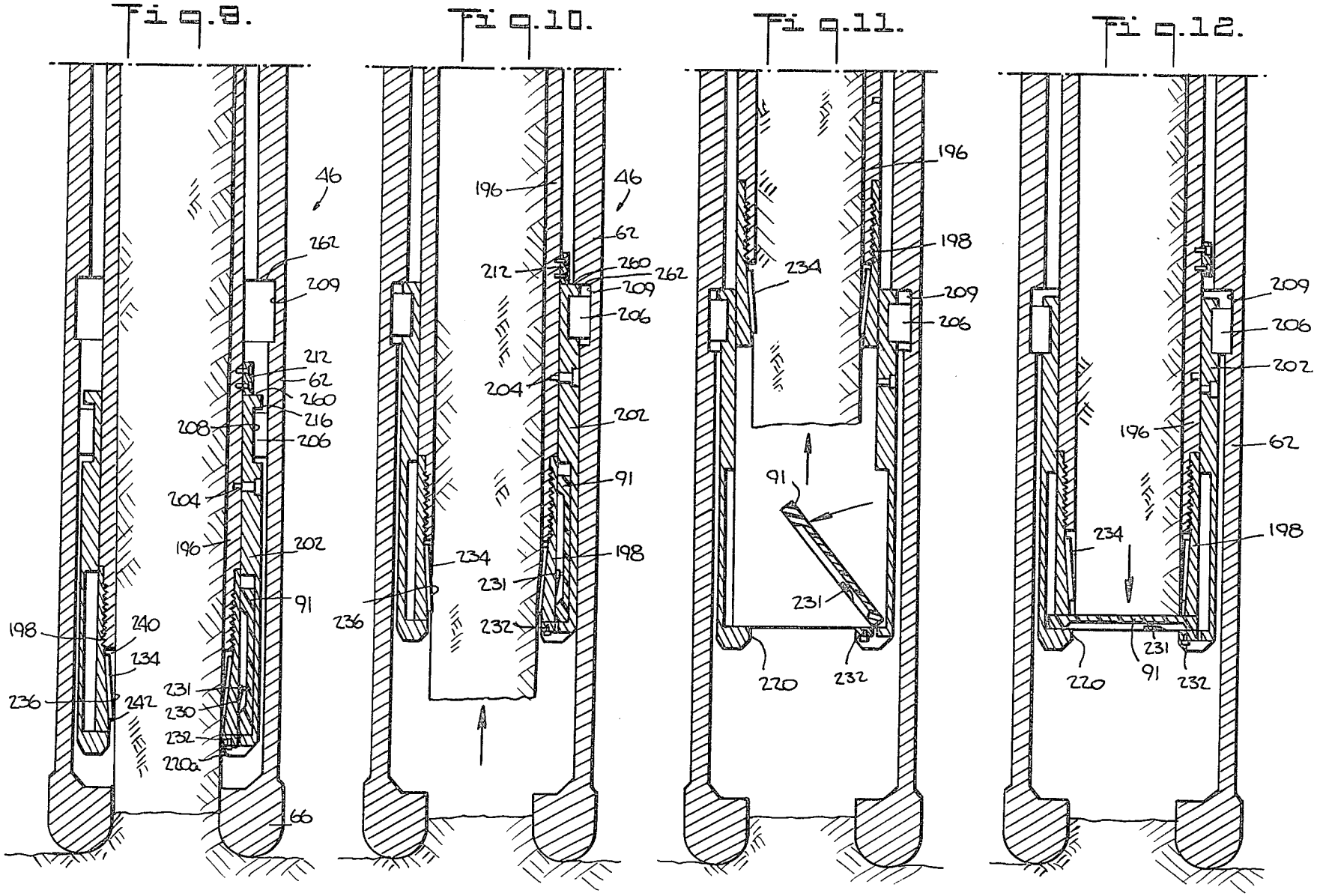
FIGS. 9 and 10 are vertical sections of the sample chamber portion of the core barrel showing a sample being cut and broken from a formation.
FIG. 11 is a vertical section of the sample chamber portion of the core barrel showing the flap member being closed.
FIG. 12 is an vertical section of the sample chamber part of the core barrel showing the flap member being engaged to seal the sample chamber.

As shown in FIG. 9, the core typically is broken from the formation adjacent the opening of the core bit. Referring to FIG. 10 and FIGS. 3-5, the drill string and upper core barrel are then rotated to a limited extent in a direction opposite to the direction of rotation used for coring with sufficient force on upper core barrel 48 to cause pins 52 to be disposed in slots 248 of the J-slots. Coring and drilling is usually accomplished by a clockwise rotation, looking down from above. Moving the drill string in a counter-clockwise direction causes pins 52 to move in slots 248 of the J-slots until the pins are positioned at the bottom of long axial slots 247. The drill string and thereby upper core barrel 48 are then lifted with the result that pins 52 travel upwardly in slots 247. This lifting moves the inner core barrel upwardly while the lower outer core barrel 46 remains stationary since upward movement of upper core barrel 48 is transferred to lower transfer tube 82A by bearing 112 and adjusting nut 106. Movement of the inner core barrel shown best FIGS. 9 and 10.

Flap-valve housing 202 moves upwardly with the inner core barrel since it is secured to sample chamber sub 196. Upward movement of flap-valve housing 202 carries resilient latch ring 206 with it in annular slot 208 of the flap-valve housing until the ring reaches annular slot 209 in core bit sub 62 of the lower barrel 46. When the latch ring reaches slot 209, it expands outwardly into the slot and is retained therein (FIG. 10). In this way sample chamber sub 196 becomes keyed by latch ring 206 to core bit sub 62 and is prevented from moving further in an upward direction. At this point, the upper end 260 of the flap-valve housing 202 abuts and engages the upper wall 262 of annular slot 209 (FIG. 2). This prevents further upward movement of the flap-valve housing with respect to core bit sub 62 of lower barrel 46.

Continued upward movement of the upper core barrel 48 and pins 52 thereof in slots 247 carries sample chamber sub 196 upwardly. Since flap-valve housing 202 is prevented from moving upwardly any further, movement of the core chamber sub 196 in response to movement of upper core barrel 48 causes shear screw 204 to be sheared thereby permitting further upward movement of the core chamber sub 196 (FIG. 11). Shear screw 204 is designed to shear at a predetermined shear stress which is sufficiently large to secure housing 202 axially to sub 196 until upper end 260 of housing 202 abuts upper wall 262 and latch ring 206 is engaged in slot 209.

As the flap-valve housing 202 and sample chamber sub 196 of the inner core barrel are raised with the drill string, core catcher 234 retains the broken core in the sample chamber 84 (FIGS. 10 and 11). Movement of the split core catcher in conical seat 236 changes the diameter of the core catcher as described hereinbefore. Thus, when the core is being lifted, it urges the core catcher to move axially downwardly. This causes a wedging action of the core catcher in conical seat 236 which results in a decrease in the inside diameter of the core catcher. The reduced diameter of the core catcher and the frictional engagement of the core with the axial teeth retain the core in the sample chamber.

The drill string continues to be raised until pins 52 approach the uppermost ends 252 of slot 247. At this point, sub 196 and the bottom portion of the core sample have been raised above flap member 91. This is shown in FIG. 11. Thus, there is nothing to restrain the flap member in its deflected, unstable configuration. Consequently, the flap member can spring into a planar configuration, pivot and fall into engagement with shoulder 220. This is shown in FIGS. 11 and 8. The flap member is prevented from moving upwardly with the core sample and sub 196 by leash 230 which secures the flap member to flap-valve housing 202. The leash is connected to the flap valve housing 202 by screw 232 and to the flap member by screw 231. The leash exerts tension on the flap member and thereby insures that the flap member pivots in the manner of a trap-door and comes to rest on shoulder 220. Flap member 91 is then in its planar configuration (FIG. 8) and in position to seal the sample chamber 84.

It should be noted that only a minimal amount of drilling fluid can enter sample chamber 84 during coring since the clearance between shoulder 220 and core bit 66 is minimal. Much of the fluid which does enter the chamber is ultimately displaced by the core sample; however, the core chamber 84 is sized with respect to the core bit opening to enable the core to move easily into the chamber and necessarily an amount of drilling fluid remains in the chamber after the core is received therein.

If the drill string is raised to a point at which pins 52 reach the upper ends 252 of J-slots 247, further upward movement of the drill will lift lower barrel section 46 from the bottom of the core hole. During this time the relative position of lower transfer tube 82A to bearing 112 and thereby upper barrel section 48 remains constant. Since spring 122 continues to bias the transfer tube 82A downwardly, nut 106 continues to bear upon bearing 112. Therefore, the point of dart 188 remains spaced apart from puncturable seal 184 and expansion chamber 180 remains sealed.

Having recieved the core sample into sample chamber 84 and having closed flap member 91, lowering of the drill string is commenced. Accordingly pins 52 travel downwardly in slots 247.

Referring to FIG. 12, the sample chamber is sealed by lowering the drill string to move pins 52 of the upper core barrel axially downwardly in slots 247. This moves sample chamber sub 196 and the core sample downwardly with respect to the lower core barrel (core bit sub 62). Since flap-valve housing 202 is restrained from axial movement by ring latch 206 which has expanded in annular slot 209, the flap-valve housing remains in the elevated position shown in FIGS. 10 and 11. Accordingly, the sample chamber sub moves downwardly relative to the flap-valve housing 202 until core catcher sub 198 abuts flap member 91 (FIG. 12). Sub 198 abuts the resilient base portion 222 of the flap member and thereby seals the sample chamber thereby.

Referring to FIG. 12, when core chamber sub 198 abuts the flap member, downward movement of the core chamber sub is prevented since the flap-valve housing 202 continues to be retained by latch ring 206 engaged in annular slot 209 of the outer core barrel. Further downward movement of the drill string after the core chamber sub 198 abuts the flap member results in relative motion between transfer tube 82A which is stationary and upper core barrel 48. Thus, as the upper core barrel 48 continues to descent, spring 122 is further compressed along stationary transfer tube 82A. As spring 122 further compressed by the downward movement of the upper core barrel applied to the upper portion of the spring by spring seat 108, the closing force applied to the flap member is increased. As a result, bearing 112 is lowered with respect to adjustment nut 106 which is engaged to stationary transfer tube 82A (FIG. 7). The continuing downward movement of upper core barrel causes upper transfer tube 82B to move downwardly while the lower transfer tube 82A remains stationary. As a result, sealing disc 184 is moved downwardly until it strikes and is pierced by dart 188. In this way the seal to the expansion chamber 80A is broken and fluids are permitted to pass from the sample chamber 84, through transfer tubes 82A and 82B, and into the expansion chamber only after the flap member has sealed the sample chamber.

At this point, pins 52 are approaching the lower end of each of axial slots 247. When the pins 52 reach the bottom of slots 247, the drill string is rotated in a clockwise direction to move pins 52 along circumferential slot 248 until the pins are positioned in axial slot 246. When the drill string is thereafter lifted and the core barrel is lifted therewith toward the surface, pins 52 become engaged in the uppermost ends 250 of axial slots 246. Accordingly spring 122 remains compressed and the flap member remains clamped thereby to enhance its seal.

The expansion chamber 80A and sample chamber 84 are connected to one another and have been sealed by the flap-valve prior to being moved upwardly toward the surface. Therefore, as the core barrel is raised to the surface, differential pressure between the interior of the sealed chambers and the exterior is formed since the exterior pressure decreases as the core barrel is raised. Fluids are free to move upwardly through the transfer tubes 82A and 82B and valves 128, 187 into expansion chamber 80A. As the core barrel is progressively lifted towards the surface, the compressible fluids (the gases and vapors) tend to expand in expansion chamber 80A as the external pressure decreases. Since member 162 is slidably movable within cylinder 156 and the external pressure is decreasing, the gages expand and cause member 162 to slide in cylinder 156 against the external pressure and weight of the drilling fluid, the drilling fluid being displaced from the cylinder through opening 142. The openings about the periphery of the triangularly-shaped terminal 86 permit passage of drilling fluid therethrough, as described hereinbefore. Member 162 continues to move until the core chamber is at least within a few hundred feet of the surface, thereby maintaining a low or essentially no pressure differential as the chambers approach the surface. Travel of packings 164A,B is limited by the top of the cylinder, stop 166 being adapted to seat in and seal opening 142. This presents deformation of the packing against the top of the cylinder and a possible loss of seal. A relief valve, not shown, is provided to insure that the pressure does not exceed a predetermined value. When the core barrel reaches the surface, the pressure within the expansion chamber can be maintained at a relatively low level, such as for example, a few hundred pounds per square inch. Thus, there is no danger in handling the core barrel since it is has relatively low internal pressure. The entire sample remains sealed in the core barrel including gases, liquids and solids. At the surface, the core barrel can be separated from the drill string. The expansion and sample chambers may also be separated, valves 128 and 187 being closed to seal the respective chambers when separated and are used to remove fluids therefrom as mentioned.

Providing a sealed sample chamber in which the differential pressure is maintained at essentially zero until the core barrel is close to the surface, insures that there is no leakage of the sample fluids during movement to the surface. This is extremely advantageous in that not only is all of the sample retained, but it also obviates the need for valves and other structure capable of withstanding differential pressures which may be in the order of 11,000 pounds per square inch or more. Since a small clearance is provided between shoulder 220 and the core bit, since the sized diameters of the sample chamber and core bit opening maintains a small clearance with the core sample, and since the expansion chamber is sealed during coring, a relatively limited amount of drilling fluid enters the sample chamber and even less is retained therein. Thus, then is little or no displacement of gases from the core sample by the drilling fluid. Additionally, little or no drilling fluid enters the expansion chamber. Essentially the entire volume of the expansion chamber is occupied by the sample fluids to the exclusion of drilling fluid. Also the sample contains only a negligible quantity of drilling fluid. The provision of a flexible flap member for the flap-valve enables the flap member to be stored in a minimum amount of space and consequently the opening into the sample chamber can be made relatively larger.

In an embodiment of the core barrel apparatus, the core barrel and drill string outer diameter can be approximately $6\frac{7}{8}$ inches. The drill string can be rotated at about 40 RPM to about 100 RPM to obtain a core sample. Additionally, the core barrel may be used to obtain a sample 60 feet in length or greater.

Figure 13:
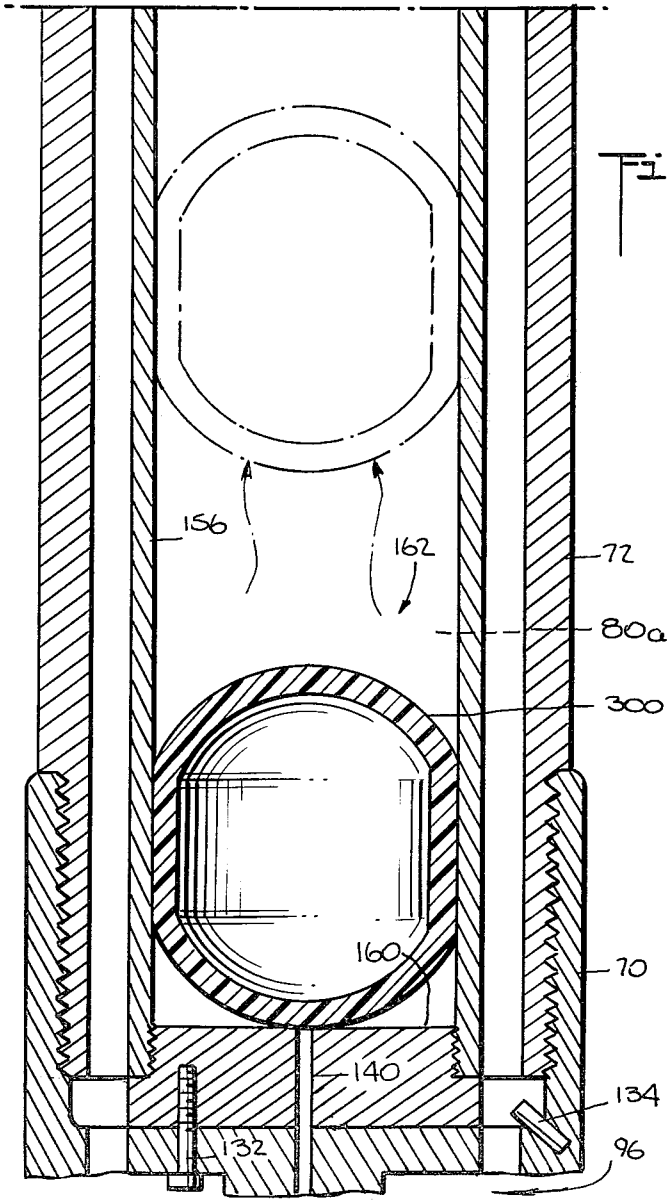
FIG. 13 is a vertical section view of part of a core barrel according to another embodiment of the invention showing the movable sealing member as a hollow deformable spheroidal member.

Referring now to FIGS. 13–16, other embodiments of sealing members are shown. In FIG. 13, the movable sealing member comprises a resilient, deformable, hollow spheroidal member 300. Member 300 may also be solid or have other shapes such as spherical or cylindrical. Member 300 forms a seal with the interior of cylinder 156 by deforming under the action of a pressure differential. At the surface, distilled water is introduced into the cylinder, member 300 installed and displaced to the bottom of the cylinder, the sealing disc installed, and the core barrel assembled and lowered as described with respect to sealing member 162. After the sample has been obtained, sealing disc 184 is ruptured and the core barrel raised towards the surface. The pressure differential described with respect to packings 164A,B causes member 300 to move upwards during ascent. However, member 300 deforms to a certain extent due to the pressure differential and/or its fit within the cylinder, and the resistance to its movement in the cylinder to form a seal for expansion chamber 80A. The seal is maintained when the member abuts terminal 86, member 300 sealing opening 142 by closing it and/or by being deformed against the walls of the cylinder.

Figure 14:
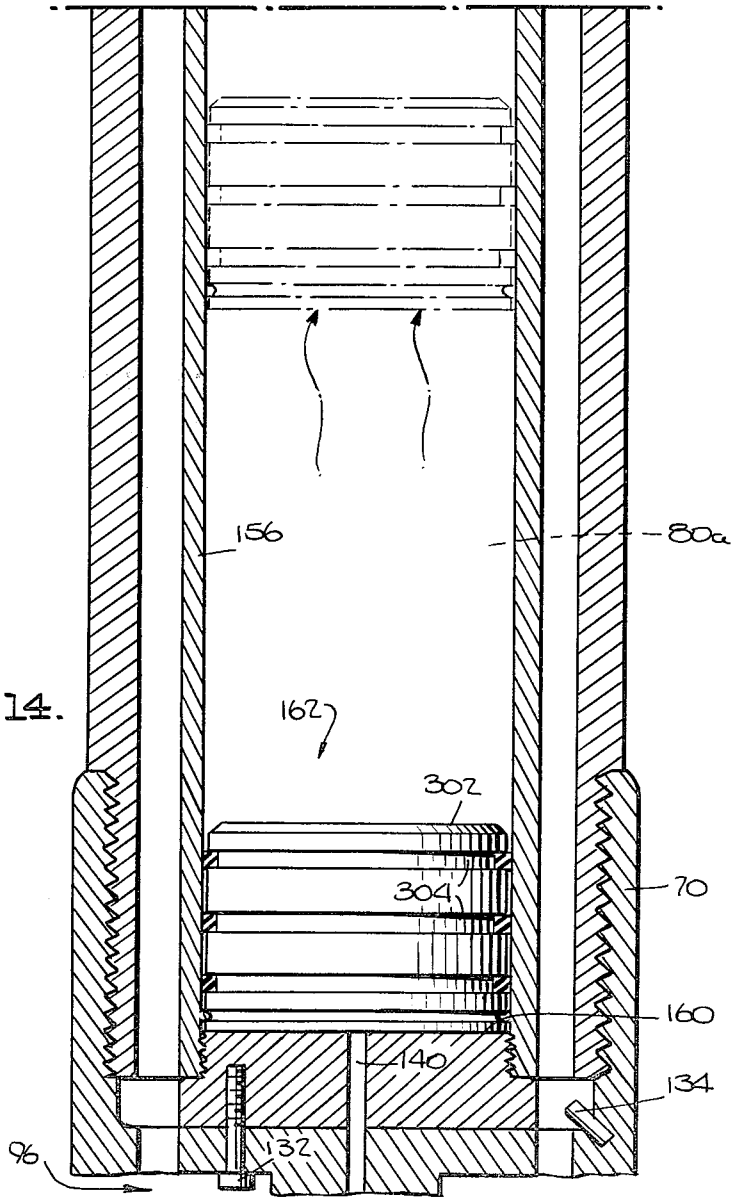
FIG. 14 is a vertical section view of a part of a core barrel according to another embodiment of the invention showing the movable sealing member as a piston.

In FIG. 14, the movable sealing member comprises a piston head 302 having sealing rings 304 located in annular grooves 306 thereof. The sealing rings provide a movable seal between the piston head and the cylinder walls.

It is also contemplated that means such as a shear pin or projection maintain the sealing member at the bottom of the cylinder until the pressure differential across the member shears the pin or projection after the differential pressure exceeds a predetermined level. Latching means may also be employed to secure the sealing member at the bottom of the cylinder, the sealing member being released upon actuation of the latching means. The latching means may be actuated by the relative axial or radial movement between the upper and lower core barrels, the inner and outer core barrels, etc., as described hereinabove.

Figure 16:
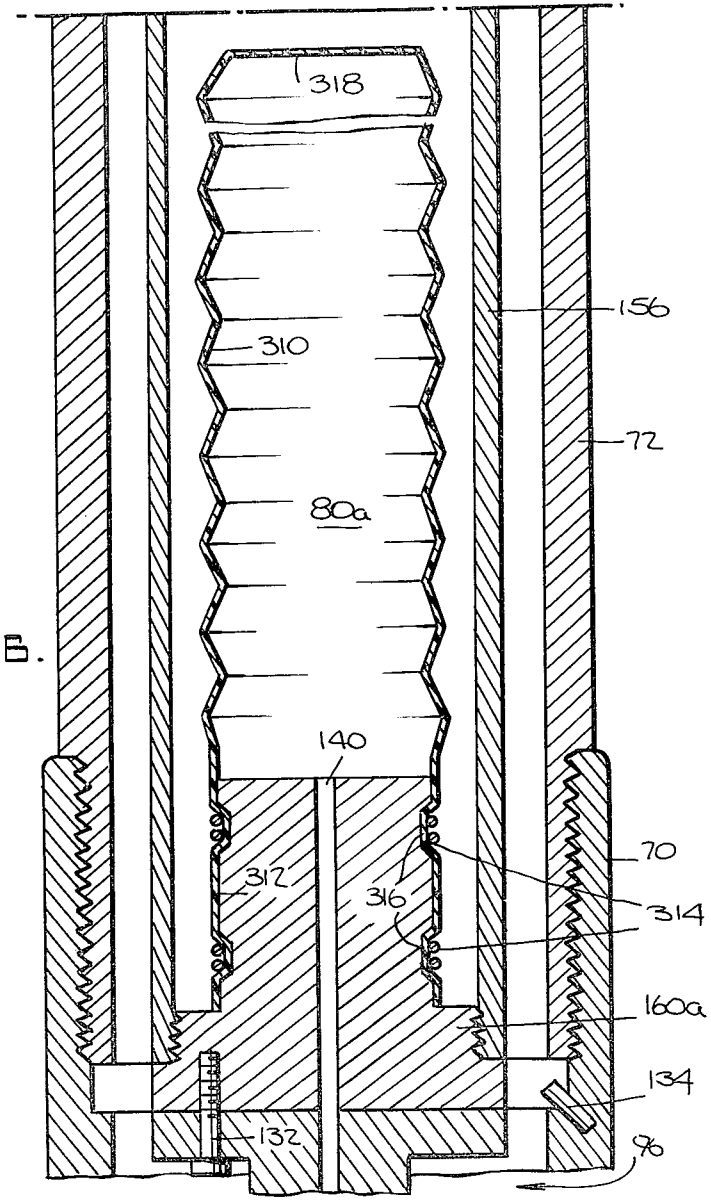
FIG. 16 is a vertical section view similar to that in FIG. 15 showing the bellows in its expanded configuration.
Figure 15:
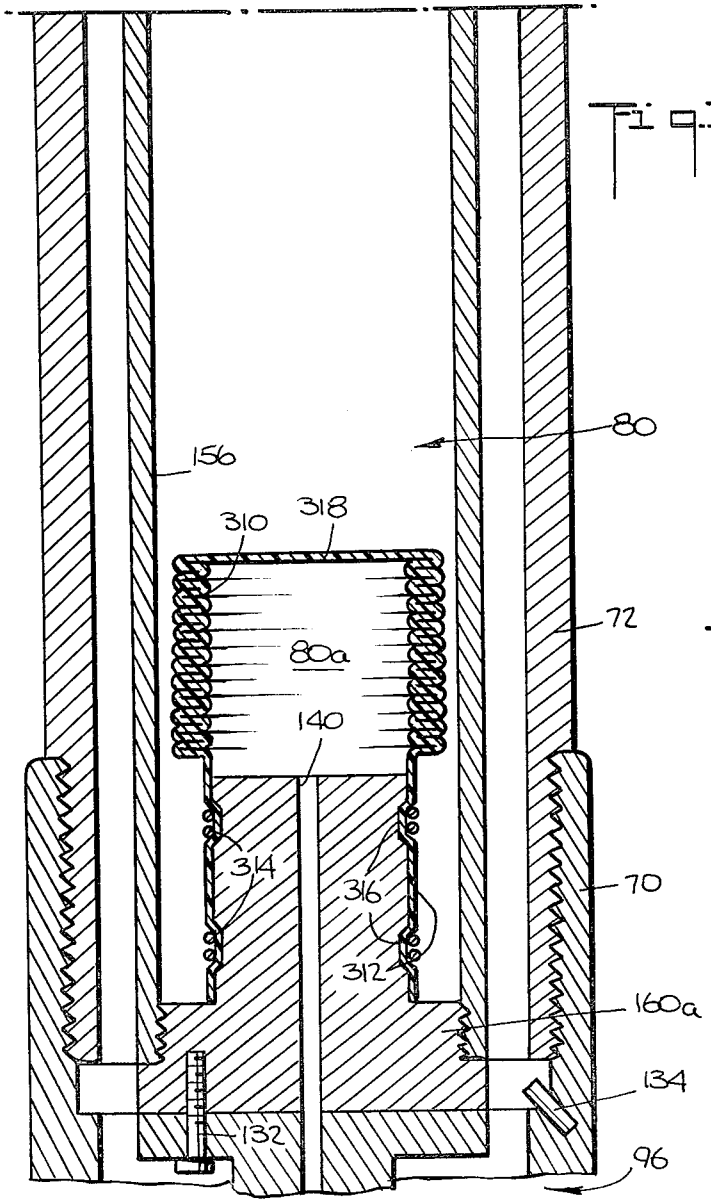
FIG. 15 is a vertical section view of part of a core barrel according to yet another embodiment of the invention showing the movable sealing member as a bellows in its contracted configuration.

In FIGS. 15 and 16, the movable sealing member comprises a bellows 310. One end 312 of the bellows is secured to terminal 96 about the central projection 160*a*. The end 312 of the bellows fits snugly about the central projection and is secured thereto by annular bands 314 seated in annular grooves 316 in the circumference of the central projection over the end of the bellows. The arrangement provides a fluid-tight seal at the lower end of the cylinder. The other end 318 of the bellows is movable. At the surface, the bellows is displaced to the contracted-configuration shown in FIG. 15 with distilled water therein, the sealing disc installed and the core barrel assembled for descent and coring as described for the sealing member 162. After a sample has been obtained, the sample chamber sealed and disc 184 ruptured, the bellows expands under the pressure differential during ascent and assumes the configuration shown in FIG. 16.

When the core barrel assembly is introduced into a bore hole, it is possible that unwanted air can be trapped within inner core barrel 78 and within the passage of transfer tube 82A up to the location of seal 84. Thus, when the opening of core bit 66 is lowered into drilling mud, air becomes trapped. The trapped air interferes with the amount of gas and vapor that can be obtained at the bottom hole conditions of the bore hole. The reason for this is that upon puncturing seal 184, the trapped air which has been compressed to bottom hole conditions enters expansion chamber 80. Accordingly, the expansion chamber must recieve a compressed volume of trapped air along with a compressed volume of bore hole gases and vapors. In addition to reducing the amount of gas and vapor related to bottom hole conditions which can be obtained, the trapped air can contaminate the core sample also being obtained.

To prevent the trapping of air, a flexible tube or hose is extended along the length of the core barrel assembly with the lower end portion of the tube disposed within the interior of the assembly, that is, extending through the opening of core bit 66, through inner core barrel 78, and through the opening of transfer tube 82A to the lower portion of dart 188. With the tube in place and the upper end portion of the tube open, the core barrel assembly is lowered into the drilling mud composition in the bore hole. Due to the venting action of the tube, air is released from the inner core barrel and the transfer tube as the mud composition enters the inner core barrel and ultimately the transfer tube. By way of example, lowering the assembly approximately 20 feet into the drilling mud composition at the surface portion of the bore hole can be sufficient to enable the mud composition to displace all air from the interior of the inner core barrel and transfer tube. As a result, there is no air available to enter the expansion chamber at the bottom hole conditions when the seal is broken to obtain the gas and vapor sample.

Another method of preventing the trapping of air within the inner core barrel is to pre-fill the inner core barrel and the transfer tube below the seal with a material which does not interfere with the gas sample to be admitted into the expansion chamber. For example, the inner core barrel and the lower portion of the transfer tube can be filled with water, a drilling mud composition, or other material compatible with the samples to be obtained and yet capable of displacing air from the assembly. The filling material such as water or mud composition can be sealed at the opening of core bit 66 by a suitable membrane or film which is adapted to be ruptured once the assembly is submerged into the mud in the bore hole. For example, a film of resin material can serve as a membrane for temporarily closing the opening of the core bit in order to maintain water or mud composition within the interior of the assembly.

What is claimed is:

1. Pressure core barrel apparatus adapted to be connected to a drill string for retrieving a core sample including solids and fluids cored from a bore hole extending into a subterranean formation comprising:

a first chamber having an opening for receiving the sample;

means for selectively sealing the opening of the first chamber after a core sample has been received in the first chamber;

a second expansible closed chamber disposed adjacent the first chamber for receiving in the interior thereof fluids from the core sample in said first chamber, said expansible chamber including a rigid-walled cylinder and movable sealing means therein for movably sealing said cylinder to seal said expansible chamber, the exterior of said movable sealing means within said cylinder being in communication with the interior of the drill string so that when disposed in a bore hole, the exterior of said movable sealing means is exposed to the ambient pressure condition of the bore hole adjacent thereto;

means for selectively connecting said expansible chamber with said first chamber to enable fluids from the first chamber to enter the expansible chamber, said expansible chamber when communicated with said first chamber being adapted to increase in volume as the core barrel apparatus with the core sample therein is brought to the surface from the subterranean formation; and means for remotely actuating the connecting means to connect the expansible chamber to the first chamber.

2. Pressure core barrel apparatus in accordance with claim 1 in which said sealing means comprises a movable member being disposed in said cylinder for movement therein.

3. Pressure core barrel apparatus in accordance with claim 2 in which said movable sealing member comprises at least one cup-like packing disposed in said cylinder and movable therein, the periphery of said packing forming a seal with the interior of said cylinder.

4. Pressure core barrel apparatus in accordance with claim 2 in which said movable sealing member comprises a piston-head disposed in said cylinder and movable therein, said piston-head including sealing means about the periphery thereof forming a seal with the interior of said cylinder.

5. Pressure core barrel apparatus in accordance with claim 2 in which said movable sealing member comprises a deformable body movably disposed in said cylinder and contacting the inner surface of said cylinder, deformation of said body forming a movable seal with the interior of said cylinder.

6. Pressure core barrel apparatus in accordance with claim 5 in which said body is hollow.

7. Pressure core barrel apparatus in accordance with claim 5 in which said body is of generally spheroidal configuration.

8. Pressure core barrel apparatus in accordance with claim 2 in which said movable sealing member comprises an expandable and contractable bellows disposed in said cylinder having one end secured fluid-tightly at the bottom of said cylinder and another opposed end movable in said cylinder.

9. Pressure core barrel apparatus in accordance with claim 2 and including first valve means for selectively closing said expansible chamber, communicating it with the atmosphere, and communicating it with said first chamber; and second valve means for selectively closing said first chamber, communicating it with the atmosphere, and communicating it with said expansible chamber.

10. Pressure core barrel apparatus in accordance with claim 2 in which said cylinder has an opening therein for the passage of drilling fluid into and out of said cylinder exterior to said movable member.

11. A pressure barrel for obtaining and retrieving a sample of a subterranean formation comprising:

an outer core barrel including means for drilling in subterranean formations to form a cored sample;

an inner core barrel enclosed by said outer core barrel comprising a first chamber for receiving the cored sample, said first chamber including means for sealing the chamber at one end thereof, a second, expansible chamber for receiving fluids from the sample, and means for selectively communicating said expansible chamber with said first chamber; and said expansible chamber including a rigid-walled cylinder and a movable sealing member therein for movably sealing one end of said cylinder to seal said expansible chamber, the exterior of said movable sealing member within said cylinder being in communication with the interior of the outer core barrel so that when disposed in a bore hole drilled in the subterranean formation, the exterior of said movable sealing member is exposed to the ambient pressure condition of the bore hole, said expansible chamber when communicated with said first chamber being adapted to increase in volume as the pressure barrel with the sample therein is brought to the surface from the subterranean formation.

12. Pressure core barrel apparatus in accordance with claim 11 and including first valve means for selectively closing said expansible chamber, communicating it with the atmosphere and communicating it with said first chamber; and second valve means for selectively closing said first chamber, communicating it with the atmosphere, and communicating it with said expansible chamber.

13. A pressure core barrel in accordance with claim 11 in which said cylinder has one end and an opposed other end and is open at said one end for permitting the passage of drilling fluid therethrough.

14. A pressure core barrel in accordance with claim 13 in which said sealing member comprises at least one cup-like packing slidably and sealingly disposed in said cylinder, the periphery of said packing being adapted to movably seal said one end from said other end.

15. A pressure core barrel in accordance with claim 13 in which said sealing member comprises a piston head slidably and sealingly disposed in said cylinder, the periphery of said piston head being adapted to movably seal said one end from said other end.

16. A pressure core barrel in accordance with claim 15 in which said sealing member comprises a deformable, ball-like body movably disposed in said cylinder adapted to seal said one end from said other end upon deformation thereof.

17. A pressure core barrel in accordance with claim 16 in which said body is hollow, resilient and of spheroidal shape.

18. Pressure core barrel apparatus in accordance with claim 13 in which said movable sealing member comprises an expandable and contractable bellows disposed in said cylinder having one end secured fluid-tightly at said other end of said cylinder and another opposed end movable in said cylinder towards said one end of said cylinder.

19. Pressure core barrel apparatus in accordance with claim 13 and comprising means for selectively communicating the interior of said expansible chamber with the atmosphere.

20. An expansible chamber for a pressure core barrel having a first fixed end and an opposed movable end, and comprising a rigid-walled cylinder having a fixed end which forms at least in part the fixed end of said expansible chamber and which is adapted to be communicated with a chamber in the core barrel for receiving a core sample, and movable sealing means disposed in said cylinder which forms said movable end of said expansible chamber for providing the movable, sealed end of said expansible chamber, said movable sealed end of said expansible chamber when said cylinder is in communication with the chamber in the core barrel for receiving a core sample being adapted to move to increase the volume of said expansible chamber as the core barrel is brought to the surface of a subterranean formation with a core sample therein taken from the formation, the exterior of said movable sealed end of said expansible chamber being selectively in communication with the exterior of said expansible chamber so that when disposed in a bore hole in the subterranean formation, the exterior of said movable sealed end of said expansible chamber is exposed to the ambient pressure condition in the bore hole.

21. An expansible chamber in accordance with claim 20 in which said movable sealing means comprises a movable member movably disposed in said cylinder and forming a movable fluid-tight seal between it and the walls of said cylinder.

22. An expansible chamber in accordance with claim 21 in which said movable member comprises at least one cup-like packing.

23. An expansible chamber in accordance with claim 21 in which said movable member comprises a piston head having means about the periphery thereof for sealingly contacting the cylinder walls.

24. An expansible chamber in accordance with claim 21 in which said movable member comprises a deformable body which forms the fluid-tight seal by deformation thereof.

25. An expansible chamber in accordance with claim 24 in which said body is hollow and of generally spheroidal shape.

26. An expansible chamber in accordance with claim 20 in which said movable sealing means comprises an expandable and contractable bellows secured at one end thereof fluid-tightly to the fixed end of the cylinder.

* * * * *

UNITED STATES PATENT AND TRADEMARK OFFICE

CERTIFICATE OF CORRECTION

PATENT NO. : 4,258,803
DATED : March 31, 1981
INVENTOR(S) : Thompson et al.

It is certified that error appears in the above-identified patent and that said Letters Patent are hereby corrected as shown below:

Column 2, line 44, delete "are" and insert --were--

Column 10, line 15, delete "trucated" and insert --truncated--

Column 14, line 41, delete "recieved" and insert --received--

Column 14, line 68, delete "descent" and insert --descend--

Column 15, line 2, after "122" insert --is--

Column 15, line 64, after "it" delete --is--

Column 16, line 19, delete "then" and insert --there--

Column 17, line 29, delete "84" and insert --184--

Signed and Sealed this

*Twenty-third* Day of *June 1981*

[SEAL]

*Attest:*

RENE D. TEGTMEYER

*Attesting Officer*

*Acting Commissioner of Patents and Trademarks*